United States Patent [19]

DeMent

[11] Patent Number: 4,956,938

[45] Date of Patent: Sep. 18, 1990

[54] SAFETY DEVICE FOR POWER OPERATED OVERHEAD DOOR

[76] Inventor: Neaville L. DeMent, 5017 78th La. N., Brooklyn Park, Minn. 55443

[21] Appl. No.: 465,506

[22] Filed: Jan. 16, 1990

[51] Int. Cl.[5] ..... E05F 15/00

[52] U.S. Cl. ..... 49/28; 49/199; 49/322; 160/193

[58] Field of Search ..... 49/28, 322, 199, 200; 160/193

[56] References Cited

U.S. PATENT DOCUMENTS

| | | | |
|---|---|---|---|
| 1,544,558 | 7/1925 | Coleman | 49/322 |
| 1,998,233 | 4/1935 | Greegor | 49/322 |
| 4,385,471 | 5/1983 | Gabry et al. | 49/322 |

FOREIGN PATENT DOCUMENTS

| | | | |
|---|---|---|---|
| 1960386 | 7/1971 | Fed. Rep. of Germany | 49/322 |
| 1173336 | 2/1959 | France | 49/322 |

*Primary Examiner*—Philip C. Kannan

*Attorney, Agent, or Firm*—Jacobson and Johnson

[57] ABSTRACT

In conjunction with a conventional power operated overhead door, such as a garage door, which has wire cables attached to the door for assisting in raising (opening) and lowering (closing) the door, a cam plate or dog having a toothed edge can be pivotably moved to instantaneously clamp or bind against the wire cable to stop its downward movement in the event any obstacle, such as a small child, is detected in the path of the door while it is being closed. The cam plate is biased to permit the wire cable to move in a direction to open the door.

8 Claims, 3 Drawing Sheets

10
2
2
15
15
16
28
27
30
20
17
12
13
12
13
14
11

15
16
11
15
28
31
27
30
32
22
21
17
25
20
15

SAFETY DEVICE FOR POWER OPERATED OVERHEAD DOOR

FIELD OF THE INVENTION

This invention provides a safety device which will immediately stop the downward or closing travel of a power operated overhead door in the event there is an obstacle in the path of the door being closed.

DESCRIPTION OF THE PRIOR ART

Power operated overhead doors have been known to present a hazard, especially to young children who may be playing in the vicinity of the door while it is being closed and may be subject to possible injury by the impact of the weight of the door in its downward travel. One type of commercially available safety device provides a sensor, such as an electric eye or a pressure detector, which will trigger or interrupt the circuitry which powers the door to remove the power and therefore stop the door in its downward travel in the event an object, such as a child, is in the path of the door while it is closing. Another safety device that is built into some power operated doors is a clutch mechanism so that if the door is impeded in its downward travel, such as by striking an object, there will be a slippage in the driving mechanism so as to minimize the amount of force that is being applied by the door against the object. One drawback of the former system is the time delay between the sensing of the object in the path of the closing door and the cutting off of the power to the mechanism. Also, it has been found that due to momentum or inertia and the weight of the door, even after the powering mechanism is disabled the door will continue its downward travel a short distance. This can be critical, especially if a child is caught under the door. The main drawback of the latter system is that even though there is slippage in the powering mechanism, some degree of force is continuously being applied onto the object underneath the door. This can be quite harmful, especially to a child caught under the door.

SUMMARY OF THE INVENTION

An anvil is mounted on the door frame and has a guide slot or groove in which the wire cable which is attached to the door is free to slide longitudinally as the door moves up and down. A cammed plate or dog is pivotable attached to the door frame with a toothed edge of the dog in close proximity to the wire cable resting in the groove of the anvil. The dog is normally spring-biased so that the toothed edge does not contact the wire cable but remains in close proximity thereto. An electromagnet is attached to the door frame with a hinged lever arm magnetically coupled thereto. The lever arm is mechanically linked to the cam plate. While the door is being closed if an object, such as a child, is detected in the path of the door, the electromagnet is energized and the lever arm moves to override the biasing force on the cam plate to pivotably swing the cam plate to bring the toothed edge of the cam plate into biting contact with the wire cable to press it against the anvil and thereby immediately bind or clamp the wire cable so that the door cannot continue its downward travel. The cam plate is pivotably mounted in a fashion such that it provides a self-locking feature so that the weight of the door applying a downward force on the wire cable acts to swing and hold the cam plate in the locking position even after the object that was in the path of the door has been removed and the electromagnet deenergized. Only after the weight of the door has been removed, which usually occurs by reversing the door travel, i.e., moving it and the wire cable upwards to open the door, will the spring-bias take over to swing the cam plate out of binding engagement with the wire cable.

DESCRIPTION OF THE PREFERRED EMBODIMENTS

Figure 1:
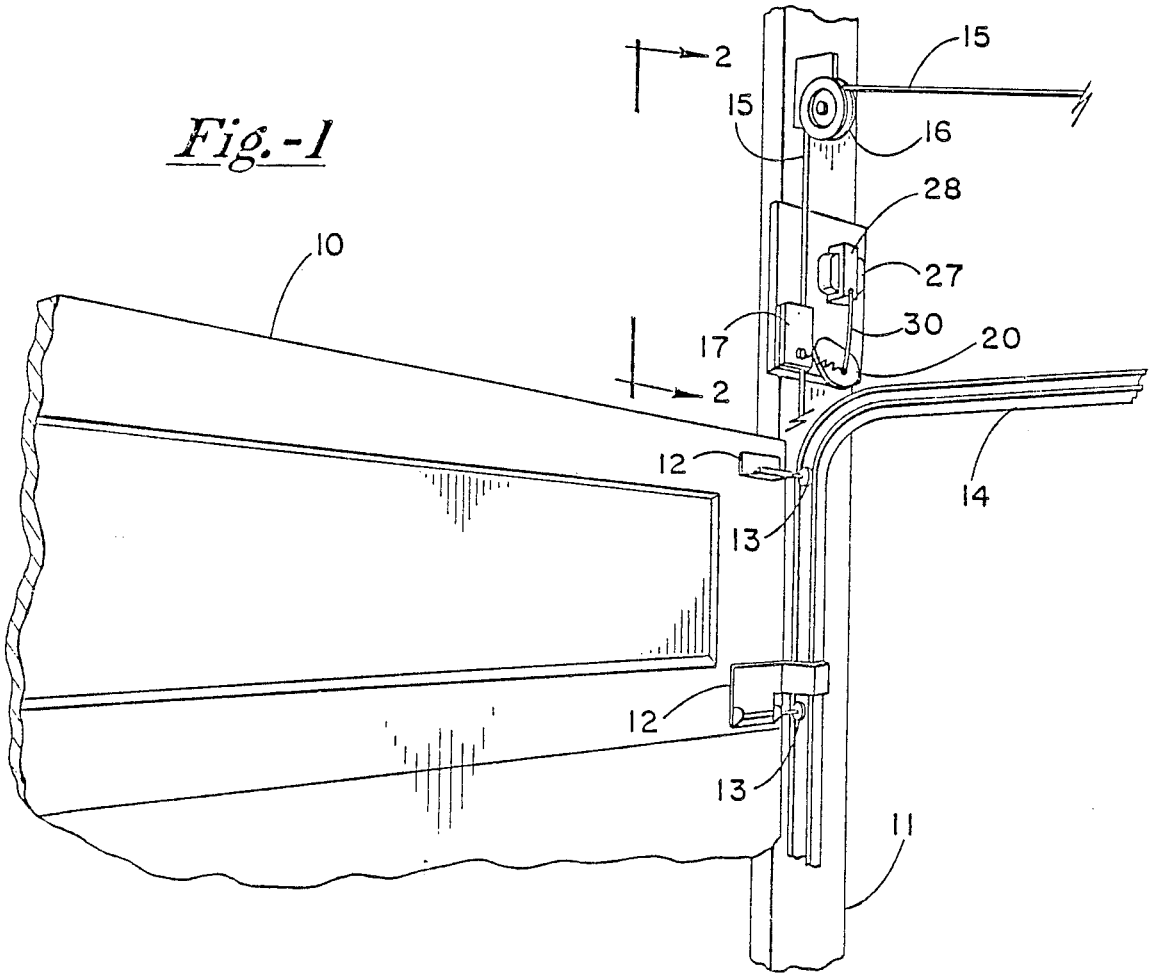
FIG. 1 is a perspective partial illustration of a typical and conventional powered overhead door which is operative in combination with an embodiment of the invention.
Figure 2:
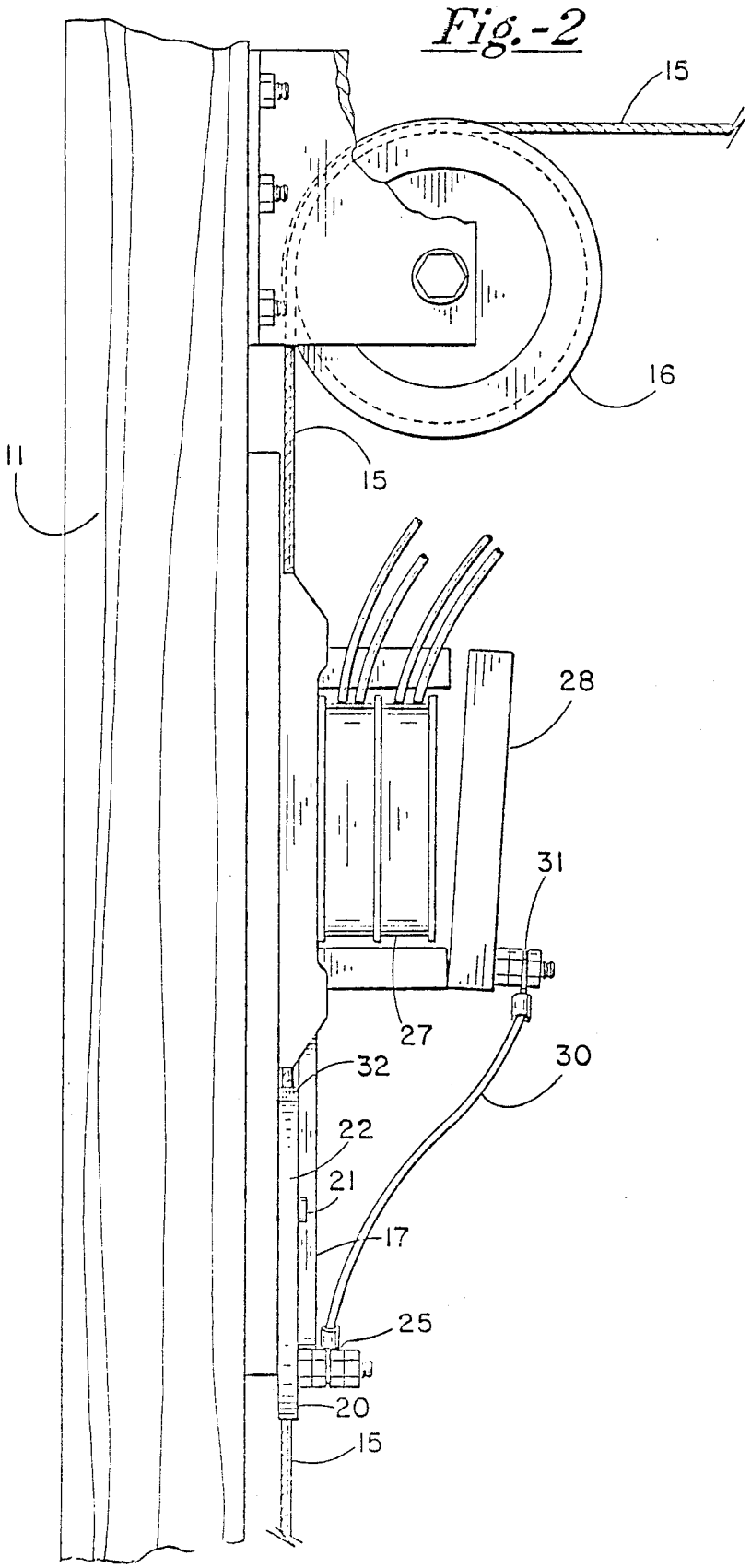
FIG. 2 is a somewhat enlarged side view of the embodiment of the invention shown in FIG. 1.
Figure 3:
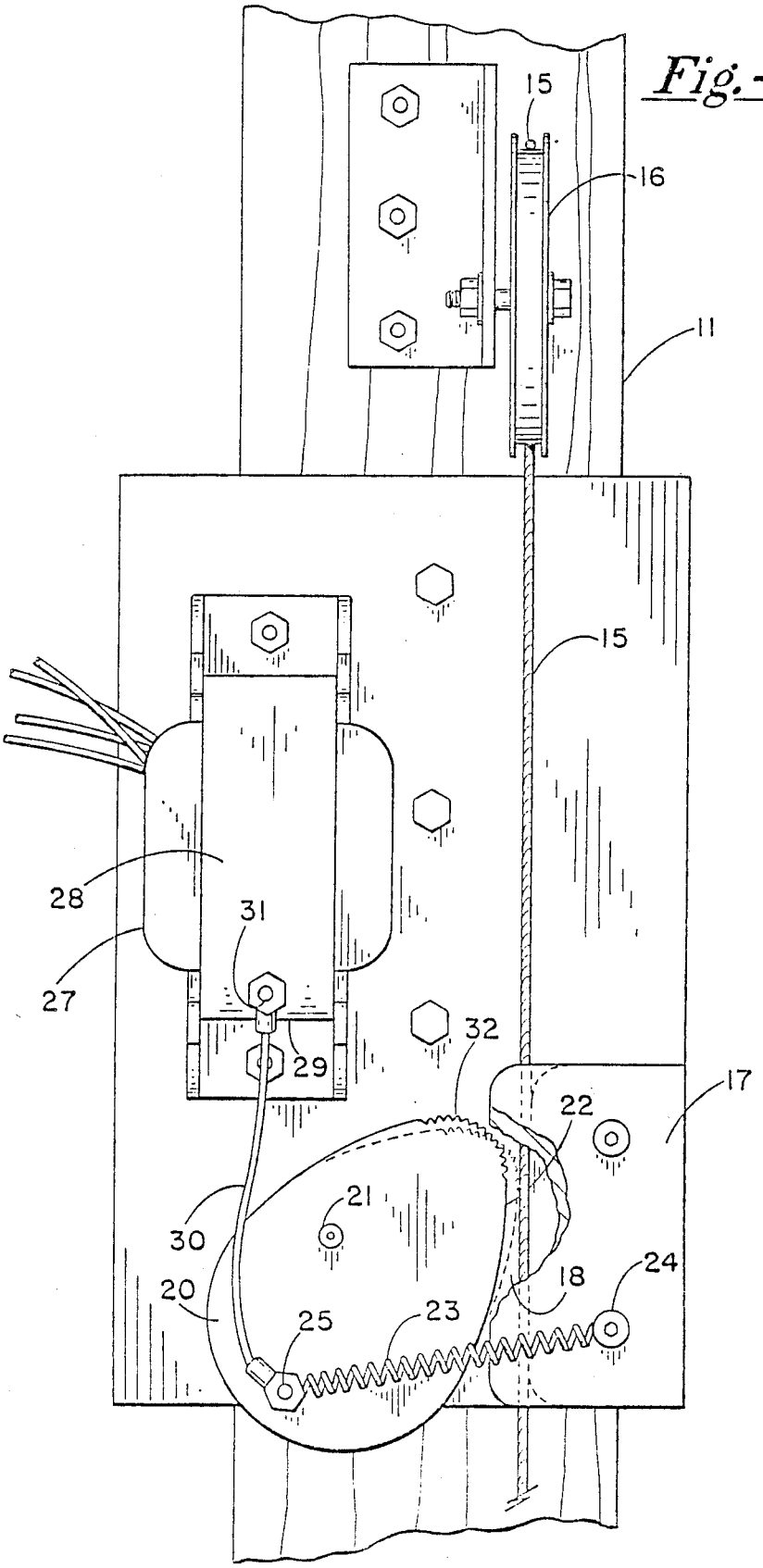
FIG. 3 is a partial breakaway front view showing more details of the embodiment of the invention.

Conventionally, an overhead door 10 is mounted within a frame 11 and has identical operating mechanisms along each side of the door. The description herein will be with respect to only one side of the door but it should be kept in mind that the same applies to the other side of the door. Conventionally, attached along the side edge of the door are brackets 12 holding rollers 13 in a guide 14 to direct and support the door in its upward (opening) and downward (closing) directions. In its fully opened position the door generally rests horizontally overhead within a garage or other enclosure. A wire cable 15 which passes over a guide pulley 16 is attached to each side of the door 10. A powered mechanical operator, not shown, which is generally driven by a motor, not shown, is usually attached at the center of the top edge of the door so that it in combination with wire cable 15, operates to close and open the door. The instant invention is designed to operate in conjunction with a conventional powered overhead door of this nature. An anvil 17 is suitably mounted in some fashion onto door frame 11 and comprises a block of metal having a groove or guide slot 18 in which wire cable 15 is slidably engaged. A cam plate or dog 20 in the form of an oblong-shaped metal plate is pivotably attached at 21 to door frame 11 with a section 22 of the edge of cam plate 20 resting in slot 18 of anvil 17 in close proximity to wire cable 15. A spring 23 is attached at one end 24 to anvil 17 and at the other end at 25 to cam plate 20 pivotally urging the edge 22 of cam plate 20 away from contact with cable 15. A stop member, not shown, holds cam plate 20 at a location so that the edge 22 still remains in close proximity to cable 15. An electromagnet 27 is mounted in some convenient fashion to door frame 11 and has a magnetically coupled lever arm 28 hingedly attached at one end 29. Lever arm 28 is linked to cam plate 20 by a pull wire 30 attached at one end 31 to lever arm 28 and at its other end at 25 to cam plate 20. Preferably edge 22 of cam plate 20 has serrations or teeth 32 which will bite into wire cable 15 when brought into contact with wire 15.

Normally with electromagnet 27 de-energized spring 23 biases cam plate 20 away from contact with wire 15 and also through pull wire 30 swings lever arm 28 upward or away from the winding or core of electromagnet 27. When electromagnet 27 is energized, the magnetic field that is produced attracts lever arm 28 pulling it downward or toward the magnetized core of electromagnet 27 with a force sufficient that pull wire 30 overcomes the force of spring 23 and moves cam plate 20 about its pivotal attachment 21 so that edge 22 is swung into biting and clamping contact with wire 15 to bind it or clamp it firmly against anvil 17.

The weight of the door acting on wire 15 tends to pull wire 15 downward which results in wire 15 applying a force to the edge 22 of cam plate 20 to further drive the teeth 32 into the wire and continue to bind it against anvil 17 which provides a self-locking feature even should electromagnet 27 be de-energized. This locking action can be released only by reversing the direction of travel of wire 15 which would ordinarily come about by reversing the travel of the door, i.e., by raising the door.

Electromagnet 27 is energized by a suitable sensor which detects the presence of an object in the way of the downward travel of the door. Typically a conventional electric eye located close to the bottom of the door travel can be used to detect the presence of an object. Alternatively, a pressure-sensing device which actuates an electrical circuit when it comes in contact with an object can be attached to the bottom of the door to energize the electromagnet. Provisions can be made for de-energizing the safety lock circuitry when the door reaches or is very close to its fully closed position so there is no danger of a child being caught underneath the closing door.

I claim:

1. For use with a frame-enclosed power operated overhead door having an attached wire cable which moves longitudinally as the door is opened and closed and has a sensor for detecting an object in the path of the door, a safety device for immediately stopping the closing of the door when an object is detected by the sensor, said safety device comprising:

an anvil attached to the frame of the door in close proximity to the wire cable;

a cam plate pivotably mounted on the door frame with an edge of the cam plate facing the anvil with the wire cable slidably located between said edge and the anvil;

means coupled to said cam plate for pivotably biasing said cam plate so that said edge of said cam plate is away from but in close proximity to the wire cable; and means coupled to said cam plate responsive to the sensor for pivotably moving said cam plate in opposition to said first mentioned means to bring said edge in pressing contact with the wire cable to bind the wire cable against said anvil to stop the longitudinal movement of the cable when the door is being closed.

2. The safety device for a powered overhead door as described in claim 1 wherein said edge of said cam plate is toothed.

3. The safety device as described in claim 2 wherein said cam plate is pivotably mounted such that said toothed edge holds the cable from moving in the door closing direction when the toothed edge is in binding contact with the wire cable.

4. The safety device as described in claim 1 wherein said means for pivotably moving said cam plate to stop the movement of the wire cable comprises:

an electromagnet energized by the sensor;

a hinged lever arm magnetically coupled to said electromagnet; and means for linking said lever arm to said cam plate.

5. For a powered overhead frame-enclosed door having an attached wire cable which moves longitudinally as the door closes and opens, a safety device, comprising:

an anvil member having an open slot, the longitudinally movable door-attached wire cable slidably engaged in said slot;

a pivotably mounted cam plate, an edge of said cam plate resting in said slot;

spring biasing means coupled to said cam plate for holding the slot-engaged edge of said cam plate away from but in close proximity to said wire cable; and means coupled to said cam plate for pivotably moving said cam plate in opposition to said spring biasing means to bring said cam plate edge against said wire cable to bind said wire cable between said edge of said cam plate and the anvil member in said slot to stop the longitudinal movement of the wire cable.

6. The safety device as described in claim 5 wherein the slot engaged edge of said cam plate is toothed.

7. The safety device as described in claim 6 wherein said cam plate is pivotably mounted so that said toothed edge holds the cable from moving in the door-closing direction.

8. The safety device as described in claim 7 wherein said means for pivotably moving said cam plate to stop the longitudinal movement of the wire cable comprises:

an electromagnet;

a hinged lever arm magnetically coupled to said electromagnet; and means linking said lever arm to said cam plate for pivotably moving said cam plate.

* * * * *